US005704145A

United States Patent [19]

Hanitz

[11] Patent Number: 5,704,145

[45] Date of Patent: Jan. 6, 1998

[54] POINT OF PURCHASE SPINNING DISPLAY

[76] Inventor: Michael G. Hanitz, 234 Elizabeth St., New York, N.Y. 10012

[21] Appl. No.: 616,650

[22] Filed: Mar. 15, 1996

[51] Int. Cl.[6] ..... G09F 13/02

[52] U.S. Cl. ..... 40/473; 40/431

[58] Field of Search ..... 40/473, 502, 431; 472/61, 72

[56] References Cited

U.S. PATENT DOCUMENTS

| | | | |
|---|---|---|---|
| 495,079 | 4/1893 | Williams | 446/253 X |
| 960,316 | 6/1910 | Hanlon . | |
| 1,361,911 | 12/1920 | Schwesinger, Jr. . | |
| 1,513,521 | 10/1924 | Robertson | 40/473 |
| 2,034,813 | 3/1936 | Holland . | |
| 2,068,414 | 1/1937 | Johnston | 40/473 |
| 2,084,915 | 6/1937 | Leitch | 40/473 X |
| 3,199,239 | 8/1965 | Reed . | |
| 3,373,917 | 3/1968 | Cox . | |
| 3,738,035 | 6/1973 | Bricker | 40/473 X |
| 3,791,058 | 2/1974 | Mollica | 40/473 X |
| 3,808,721 | 5/1974 | Gersch | 40/502 X |
| 3,947,985 | 4/1976 | Skrzypczak | 40/473 |
| 3,964,190 | 6/1976 | Leo . | |
| 4,008,534 | 2/1977 | Swartz . | |
| 4,490,932 | 1/1985 | McIntire | 40/473 |
| 4,910,898 | 3/1990 | Hector | 40/479 |
| 5,196,961 | 3/1993 | Sun . | |
| 5,205,636 | 4/1993 | Carpenter | 472/61 X |

*Primary Examiner*—Joanne Silbermann
*Attorney, Agent, or Firm*—Jones, Tullar & Cooper, P.C.

[57] ABSTRACT

A kinetic rotating display for use as a point of purchase inducement to customers in a retail environment. The display includes a two-sided transparent panel with fluorescent printed indicia or graphics on one side which are illuminated by ultraviolet light. The other side of the panel has these indicia or graphics masked off with an opaque layer. The panel is rotated about its central axis at a rotational velocity of 300–3000 RPM. The spinning fluorescent indicia, when illuminated in this fashion, create the illusion of a solid through the persistence of vision.

12 Claims, 4 Drawing Sheets

POINT OF PURCHASE SPINNING DISPLAY

BACKGROUND OF THE INVENTION

The present invention pertains, in general, to signs and displays for use in a retail environment. The display is kinetic and its motion attracts the eye of the customer.

There have been a number of kinetic displays which have been used as objects of dynamic art. It is known to use ultraviolet radiant energy in conjunction with such displays. Ultraviolet radiant energy has a visible light component and a component which is outside the visible spectrum. It is also known to irradiate various materials with ultraviolet light, where these materials are thereby caused to fluoresce in the visible spectrum. The light is conventionally known as "black light" and the materials are conventionally known as "fluorescent" materials. For example, U.S. Pat. No. 4,008,534 discloses a rotating display which includes fluorescent circular display members and a stroboscopic ultraviolet light source. This display can create a striking visual impression, but it is not capable of conveying a message.

For those who are attempting to compete in today's crowded retail environment, it is important to try to catch the eye of the customer in order to convey a message. Frequently, displays at the point of purchase can be a valuable inducement to buy. A number of commodities are packaged and displayed specifically for creating the impulse to buy in the customer.

In the prior art, displays have included devices for making noise, robotic arms for waving at the customer, flashing lights for periodically illuminating an attractive graphical image and the usual assortment of pictures with smiling young models, cuddly puppies and adorable children. This competition for the eye of the customer has created a colorful and brightly lit morass of visual stimuli which only serves to clutter the retail space. Accordingly, customers have become more jaded and now ignore most point of purchase displays in the retail space. There has been a long felt need then for a point of purchase display which does not significantly add to the distressing visual clutter impinging on the customer but which does attract the customer's attention and invites a second look, thereby getting a message across to the customer.

SUMMARY OF THE INVENTION

The present invention is directed to a kinetic display which will make a printed message or a graphical symbol appear to be suspended in thin air. The display includes a transparent panel which is adapted to spin on its central axis. The panel has a front side and a back side, and the front side of the panel includes a message composed of alphabetical characters, numerals, graphical symbols or pictorial works which are printed using fluorescent materials. Opaque mask characters are used on the back side of the panel to cover these fluorescent characters. The display also includes an ultraviolet light (black light) which provides a continuous source of illumination for the fluorescent graphics. When the panel is rotated about its central axis at a sufficiently high speed (300–3000 RPM), persistence of vision renders the graphics as an illusion of a solid. Once the display is spinning, it appears to the customer that the graphics are hanging in thin air and glowing brightly. This creates a visual curiosity which attracts and delights the customer. By attracting the customer to an interesting floating message, the advertiser can overcome the visual clutter in the retail space.

It is an object of the present invention to create an attractive display that creates a brightly lit message which appears to hover in space. It is also an object of the present invention to create a display which will stand out from the other displays which typically populate a retail point of purchase. It is a further object of the present invention to create an attractive visual display which will arouse curiosity in the customer.

BRIEF DESCRIPTION OF THE DRAWINGS

The foregoing and additional objects, features and advantages of the invention will become apparent to those of skill in the art from the following detailed description of a preferred embodiment, taken with the accompanying drawings, in which.

DETAILED DESCRIPTION

Figure 1A:
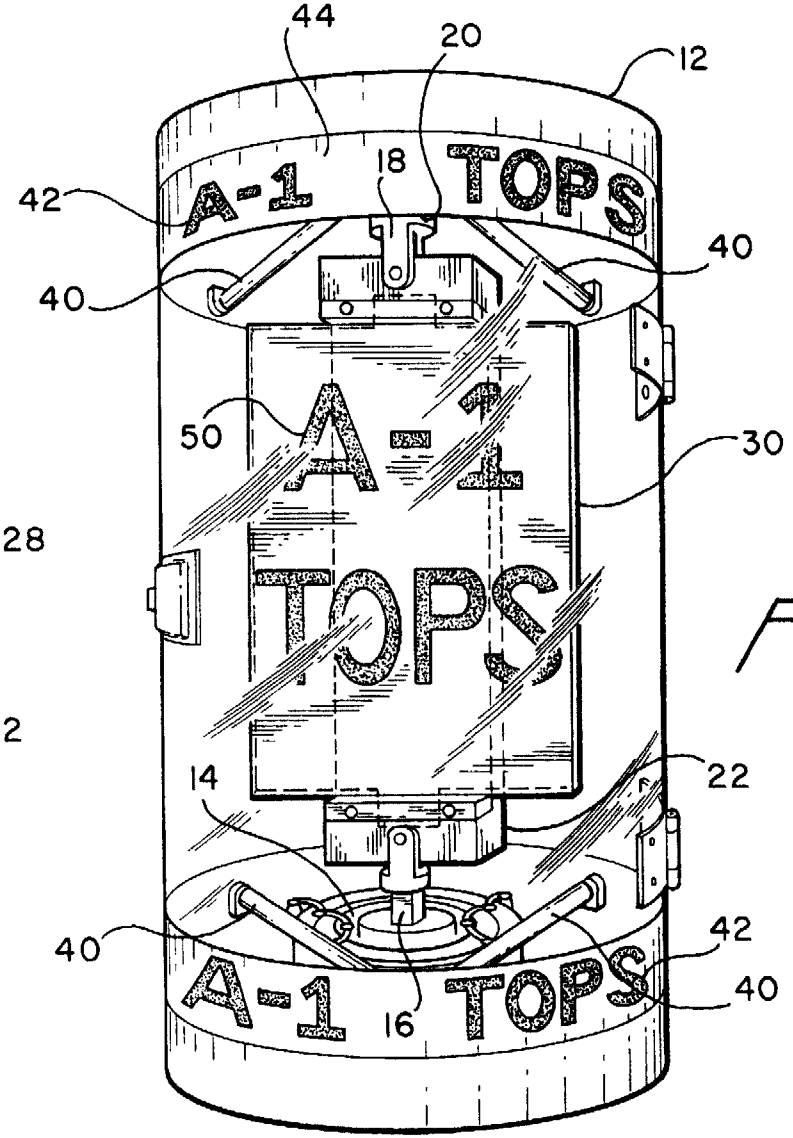
FIG. 1*a* shows a first embodiment of the point of purchase display.
Figure 1B:
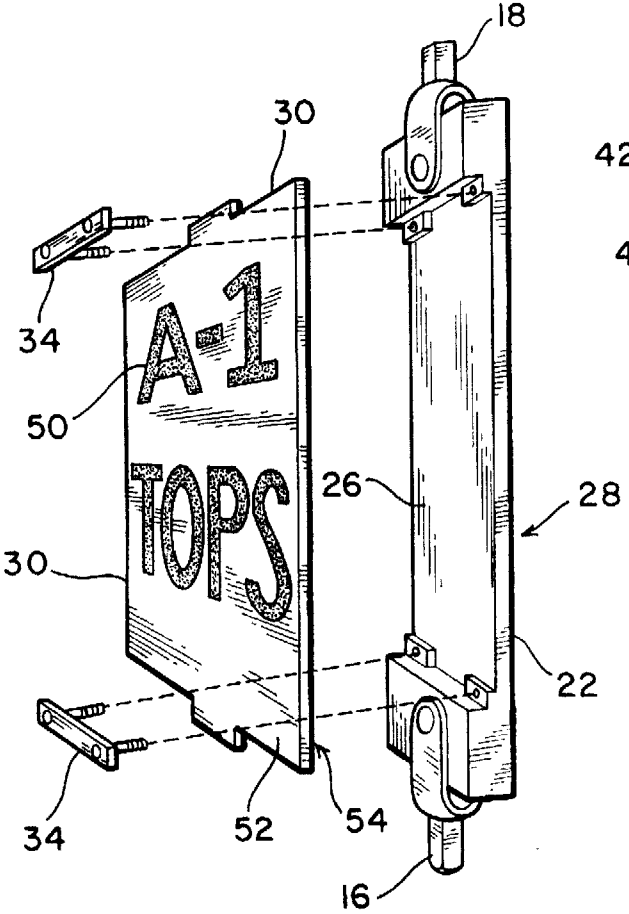
FIG. 1*b* shows a view of the fastening apparatus for the interchangeable display sign.

Turning now to a more detailed description of the invention, there is illustrated in FIGS. 1*a* and 1*b*, a first embodiment of a rotating point of purchase display 10. The display is housed in an enclosure 12 which may be fabricated from plexiglass, glass, acrylic or any other transparent material. In the preferred embodiment, the housing is in the shape of a cylinder, however, any suitable or attractive shape may be used. The housing may have a hinged opening which permits access to the display components. Within the housing is a drive motor 14. The drive motor serves to rotate a lower shaft 16 at a selected speed. The speed is selected to be between 300 and 3000 RPM, however, any speed which takes best advantage of the persistence of vision is to be desired. This selected speed may vary with the size, shape and color of the display. An upper shaft 18 is suspended from a bearing 20 within the top of the housing and is adapted to spin freely in response to the input from the motor 14. Display panel support 22 is affixed to the upper shaft 18 and the lower shaft 16 and is driven in a spinning motion (about a central axis which is coaxial with shafts 16 and 18) by the operation of motor 14. The display panel support 22 is thus rotatable through 360 degrees of rotational orientation. As shown in the perspective views of FIGS. 1*a* and *b*, it is anticipated that customers viewing the sign will be standing generally in front of the sign, thus an angular sweep of the panel support 22 including 180 degrees may be said to include all of the rotational orientations of interest.

The panel support 22 has a front side 26 and a back side 28. In the preferred embodiment, a transparent detachable acrylic panel 30 is attachable to the front side of the panel support 22. The panel 30 can be attached to the panel support 22 by threaded fasteners with a bracket 34 or suitable snap-in fasteners or the like. The panel 30 may also be attached by hook and loop fasteners (not shown). With the changeable panel 30 of the first embodiment of FIG. 1*a*, a number of different advertisers messages can be displayed using one display. Alternatively, a single advertiser can have changeable messages on different signs.

Ultraviolet (black) lights 40 are situated within the top and bottom portions of the display housing 10. Black lights 40 may be General Electric model F4T5/BLB lamps, or the like. These are arranged about the sign in a semi-circle to illuminate the display panel 30. These black lights provide continuous illumination to the interior of the display enclosure 12 and are positioned to provide uniform illumination to the sign over all of the sign's rotational orientations of interest, as defined above. If, at a minimum, one light is used, then that light should be positioned in close proximity to one side of the housing, and the display is aimed to have that side of the housing oriented toward the viewer.

These lights may also serve to back-light external printed indicia 42, which may be translucent or transparent and are preferably printed on the outer surface of the housing 12. These external indicia 42 are translucent and stand out in relief against an opaque background region 44. Alternatively, the external indicia 42 may be opaque and be surrounded by a translucent background region in relief.

A message made up of printed indicia or a graphical design 50 are applied to the front side 52 of the transparent panel 30. An opaque masking layer (not shown in FIG. 1) is applied to the back side 54 of the transparent panel. The orientation of the masking layer precisely covers the indicia 50, thereby making the indicia non-reflective when the front of the panel support 26 is rotated away from the lamps. Another approach to locating the masking layer is to first apply the masking layer to the front side 52 of the panel 30 as an opaque, preferably flat black, base coat which is visible through the transparent panel 30 and then to apply the fluorescent layer 50 over that base coat, so that the fluorescent layer is visible from the front side 52 of the panel but not from the back side 54 of the panel.

Figure 2:
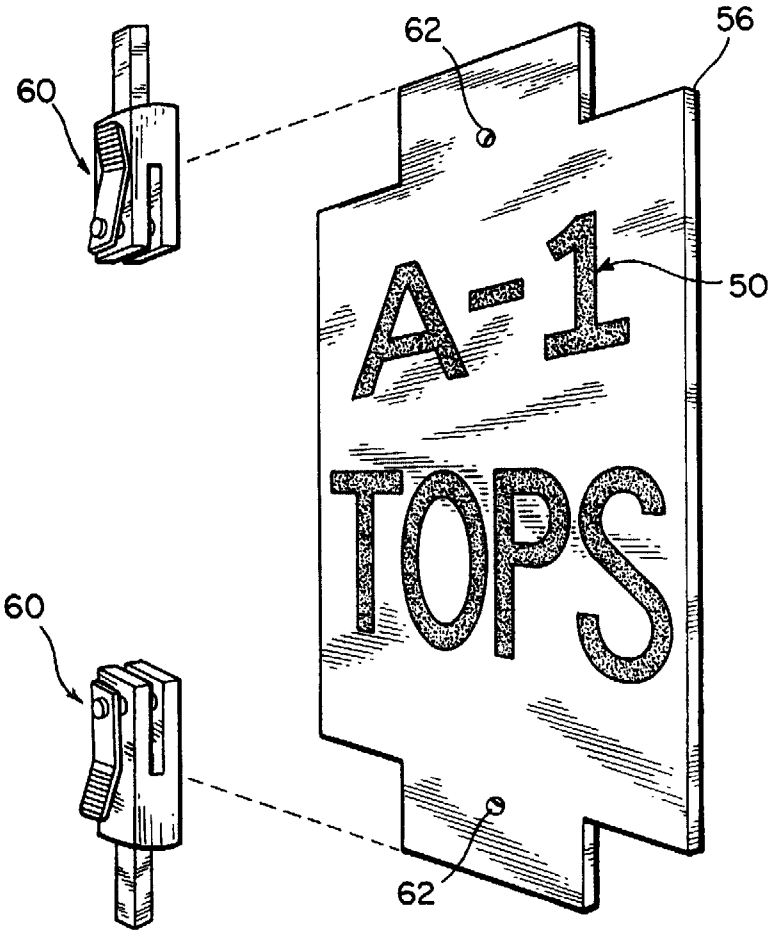
FIG. 2 shows a second embodiment for the interchangeable panel of the display of the present invention.

Turning now to FIG. 2, a second embodiment for the interchangeable transparent panel 56 is illustrated. The display may be adapted to include clevis pins 60 which can be used to secure the transparent panel 30 through matching apertures 62. This embodiment does away with the separate panel support 22 and combines the functions of the panel support and the panel 30 into a unitary panel structure 56. The unitary panel 56 is also transparent and includes the fluorescent characters 50 and opaque masking characters, as above.

Figure 3:
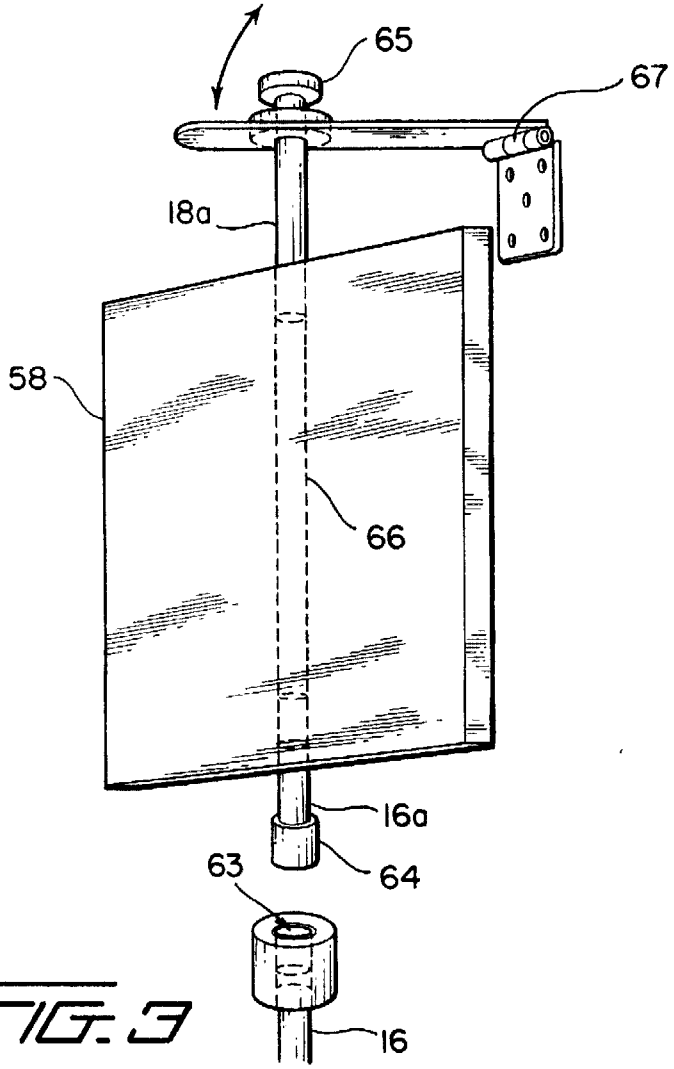
FIG. 3 shows a third embodiment for the interchangeable panel of the display of the present invention.

Turning now to FIG. 3, a third embodiment with a interchangeable transparent unitary panel 58 is illustrated. The lower drive shaft 16 for driving the transparent panel includes a coupler well 63 which receives a shaft 16*a* terminated in a rubber boot 64. Rubber boot 64 fits snugly in coupler 63 and static friction prevents the boot from rotating within the coupler. The coupler 63 supports and drives the shaft 16*a* and is selectively separable from the shaft 16*a*, which may be withdrawn. At the top of the panel, an upper shaft 18*a* is terminated in a removable rubber cap 65 which fits within an upper coupler (not shown). The transparent panel 58 includes a central cylindrical aperture 66 which can receive either a continuous shaft (not shown) or can be used with upper and lower half shafts 18*a*, 16*a*, as shown; in either case, the shafts are fixed to the panel and, when driven, rotate the panel about the central axis of the shafts. A hinge 67 allows selective decoupling of the panel, thus allowing the panel to be serviced or removed.

Figure 4:
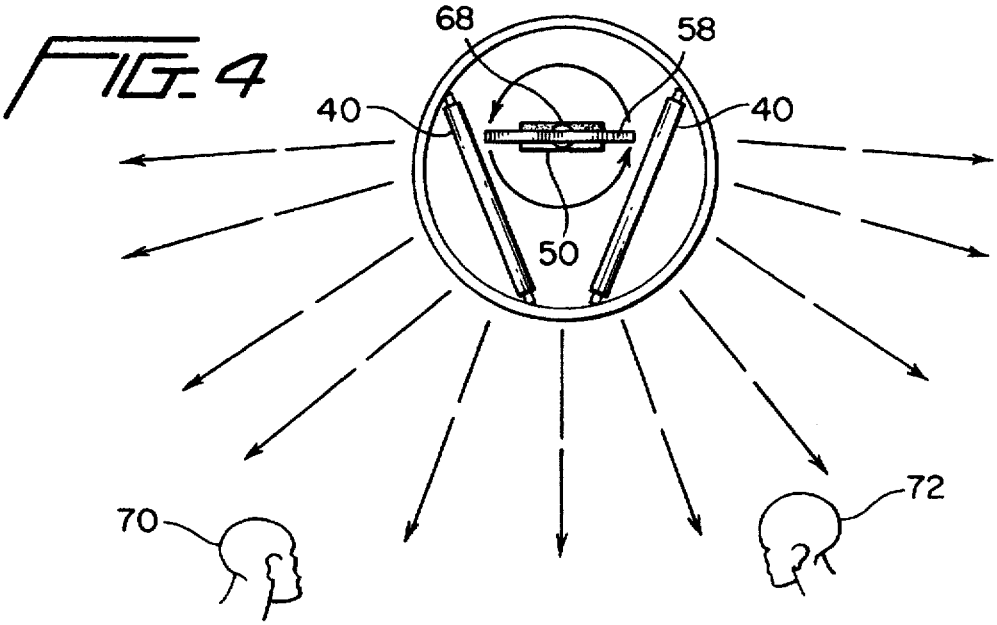
FIG. 4 illustrates a top view of the preferred embodiment for the point of purchase display showing, in section, the interior of the display.

Turning now to FIG. 4 it is illustrated that the rotating unitary panel 58 is illuminated by ultraviolet lights 40. The light is reflected from the fluorescent printed indicia 50 on the front of the panel. Masking elements 68 are shown on the back of the transparent panel and prevent a viewer 70 from seeing the indicia 50 through the back side of the transparent panel.

Viewer 70 and a second viewer 72 are separated by an angle of azimuth, as measured from the panel. The two viewers are within a range of azimuth angle which is defined as including all the panel's rotational orientations of interest. These orientations define an angular sweep of the panel which is intended to be observed by viewers.

Figures 5A, 5B, 5C:
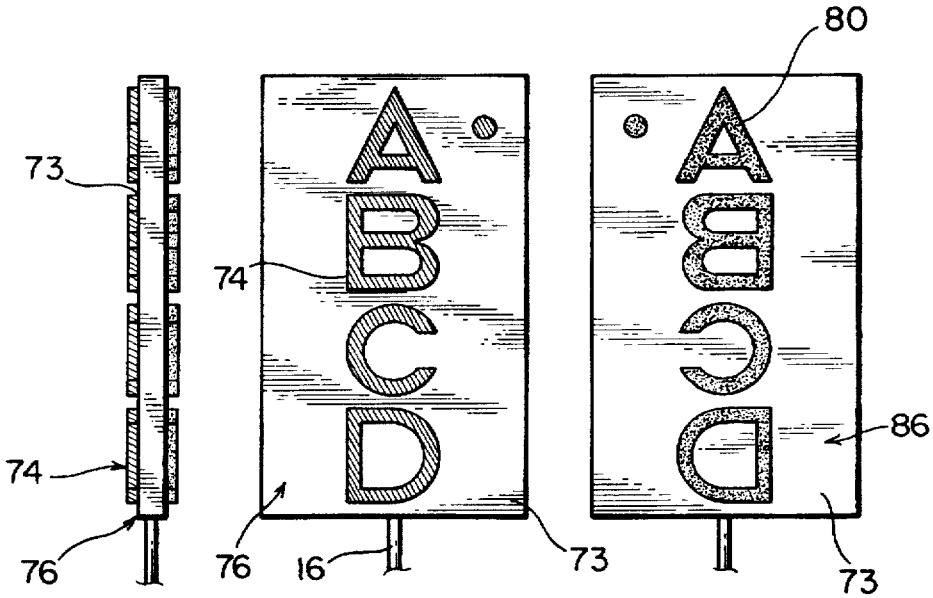
FIG. 5*a*, FIG. 5*b*, FIG. 5*c* and FIG. 5*d* show another embodiment for the display panel.
Figure 5D:
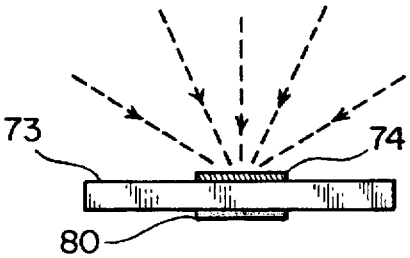

FIGS. 5*a–d* illustrate four views of another embodiment of the present invention where a lower shaft 16 is inserted directly into a clear acrylic panel 73. The fluorescent printed indicia 74 is printed on the front side 76 of the panel 73. The opaque, preferably flat black, mask indicia 80 are printed on the backside 86 of the panel. FIG. 5*a* shows a side view, FIG. 5*b* shows a front view, FIG. 5*c* shows a back view, and FIG. 5*d* shows a top view of this embodiment of the panel 73.

Figure 6:
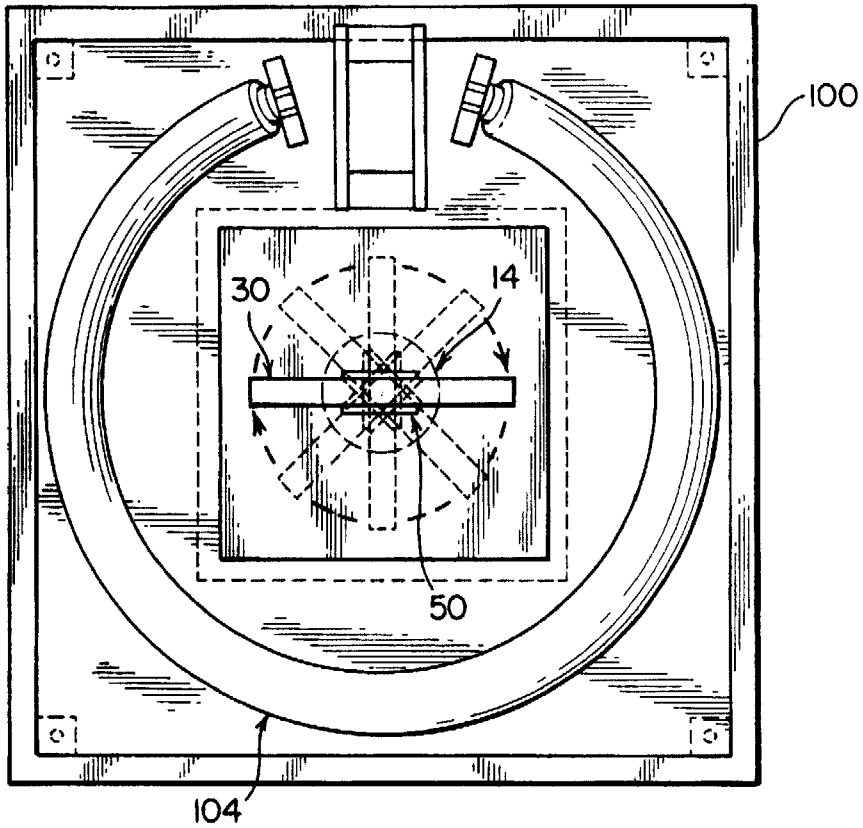
FIG. 6 shows a top view of another embodiment of the display of the present invention.

Turning now to FIG. 6, there is illustrated a top view of a second embodiment of the display enclosure 100. In this embodiment, the enclosure is approximately square and a roughly circular black light 104 is used for illumination of the display. This view is a sectional view looking from within the enclosure towards the bottom of the enclosure. Circular light 104 may be a General Electric model FCA21/BLB, or the like. The circular light gives a uniform effect to the display for viewers at a wider range of azimuths (or for a wider range of rotational orientations of interest).

Figure 7:
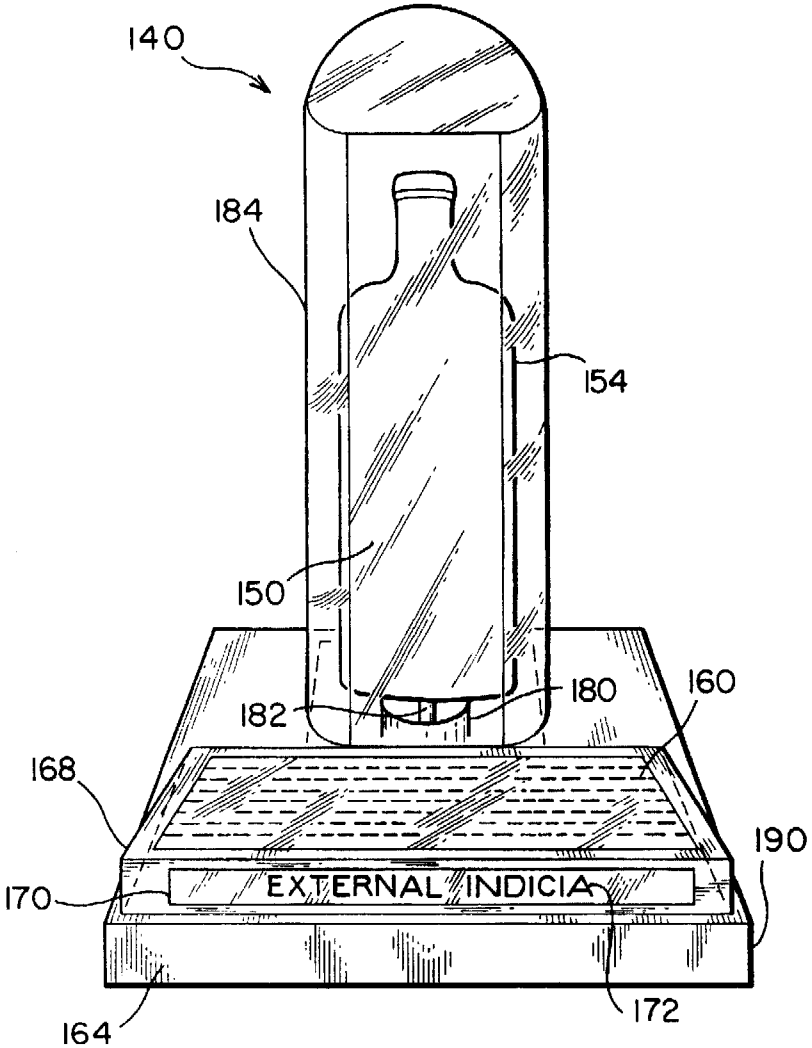
FIG. 7 shows a front perspective view of another embodiment of the display of the present invention.

Another embodiment of the display 140 is illustrated in FIG. 7. A pictorial work 150 is rendered on a panel 154 of a selected shape, in this case, a liquor bottle. The pictorial work could be representative of any desirable image, such as the Empire State Building, the Statue of Liberty, a cartoon character, or a commodity for sale in a retail environment. The shape of the panel can be adapted to the shape of the subject represented. In the embodiment of FIG. 7, ultraviolet lights 160 are situated proximate to a chosen side 164 of the display. The lights are supported within a shadow box 168 and illuminate the panel 154. A translucent or transparent window 170 can be back lit by the lights 160 for highlighting the external indicia 172, as above. A motor 180 supports and rotates the panel 154 through a lower shaft 182. The panel 154 is situated within a transparent enclosure 184 which is supported by a housing base 190. In this embodiment, the panel is lit from the chosen side 164 by the lights 160. The rotational orientations of interest for the panel are then oriented toward the chosen side 164 and the display 140 must be aimed so that the chosen side is closest to the viewer.

In use, for all embodiments, the motor is used to spin the panel, preferably at approximately 1500 RPM. This rotational velocity has been experimentally determined to give the best visual effect. The critical factor here is that a rotational velocity must be chosen which is well suited to take advantage of the persistence of vision in the viewer's eye. A particular size, shape and color of indicia may be well suited to a rotational velocity of more or less than 1500 RPM (but still in the range of 300–3000 RPM).

The ultraviolet light illuminates the spinning fluorescent message 50 and, from the viewer's position, 70, the message (defined herein as indicia or graphics) appears to take on a three-dimensional character and appears to hang in space.

By enclosing the rotating panel in a housing, a self-contained, portable and safe display is produced. This permits the retailer to simply plug the display in and turn it on, without any bothersome setup procedure to follow. The retailer need not worry about how to arrange the lights to best illuminate the panel for a predetermined rotational orientation of interest. The retailer can instead be instructed to simply aim the entire display at the customer's intended location, adjacent the point of purchase in the retail space. This intended location must be included within the angular sweep of the panel's rotational orientations of interest, as defined above.

The foregoing describes the preferred embodiments of the present invention along with a number of possible alternatives. A person of ordinary skill in the art will recognize that modifications of the described embodiments may be made without departing from the true spirit and scope of the invention. The invention is, therefore, not restricted to the embodiments disclosed above, but is defined in the following claims.

I claim:

1. A display comprising:

a transparent panel having front, a back and a central axis passing through said panel between said front and said back;

a fluorescent pattern disposed on said panel and viewable at said front of said panel;

masking on said panel for preventing said fluorescent pattern from being viewed through said back of said panel;

an ultraviolet light for illuminating said fluorescent pattern; and a drive mechanism for rotating said transparent panel about said central axis.

2. The display of claim 1, further including a transparent enclosure for supporting and positioning said panel and said ultraviolet light.

3. The display of claim 2 wherein said enclosure includes backlit external indicia.

4. The display of claim 1, wherein said panel is rotated at a chosen number of revolutions per minute, where the chosen rotational velocity is between 300 and 3000 revolutions per minute.

5. The display of claim 4, wherein said chosen rotational velocity is approximately 1500 revolutions per minute.

6. The display of claim 1, wherein said pattern further comprises a message.

7. A display for creating a persistence-of-vision illusion comprising:

a transparent panel having first and second sides and a central axis passing through said panel between said first and second sides;

a fluorescent pattern disposed on the first side of said panel;

an ultraviolet light for illuminating said fluorescent pattern;

a drive mechanism for rotating said panel about a central axis at a speed of at least approximately 300 revolutions per minute; and masking means for preventing said fluorescent pattern from being viewed through one of said sides of said panel.

8. The display of claim 7, wherein said pattern further comprises a message.

9. The display of claim 7, wherein said pattern further comprises a message.

10. A method for creating a persistence-of-vision illusion in a display comprising the steps of:

providing a transparent panel having first and second sides, a central axis passing through said panel between said first and second sides, and a fluorescent pattern on one of said sides;

illuminating said fluorescent pattern with ultraviolet light;

rotating said panel about said central axis at a speed of at least approximately 300 revolutions per minute to generate said persistence-of-vision illusion; and providing masking on said transparent panel for precenting said fluorescent pattern from being viewed through one of said sides of said panel.

11. The method of claim 10, wherein said panel is provided with a fluorescent message thereon.

12. The method of claim 10, wherein said panel is provided with a fluorescent message thereon.

* * * * *